United States Patent [19]

Schmidt

[11] Patent Number: 4,973,547

[45] Date of Patent: Nov. 27, 1990

[54] PHOTOGRAPHIC MATERIAL

[75] Inventor: Wolfgang Schmidt, Colonge, Fed. Rep. of Germany

[73] Assignee: Agfa-Gevaert Aktiengesellschaft, Leverkusen, Fed. Rep. of Germany

[21] Appl. No.: 261,562

[22] Filed: Oct. 24, 1988

[30] Foreign Application Priority Data

Nov. 7, 1987 [DE] Fed. Rep. of Germany ..... 3737962

[51] Int. Cl.[5] ..... G03C 1/02

[52] U.S. Cl. ..... 430/567; 430/569

[58] Field of Search ..... 430/569, 567

[56] References Cited

U.S. PATENT DOCUMENTS 4,433,048 2/1984 Solberg et al. ..... 430/569

OTHER PUBLICATIONS

The Journal of Photographic Science, vol. 3, 1955, pp. 73–87; Evans et al.; "Further Contribution to the Theory of Photographic Sensitivity".

*Primary Examiner*—Paul R. Michl
*Assistant Examiner*—Thomas R. Neville
*Attorney, Agent, or Firm*—Connolly and Hutz

[57] ABSTRACT

A photographic material comprising a support and at least one photosensitive silver halide emulsion layer, the silver halide grains of this silver halide emulsion layer having a layered structure of at least two layers, which extend to the surface of the grain, and being selectively etched, is distinguished by improved sensitivity and reduced fogging.

2 Claims, 2 Drawing Sheets

PHOTOGRAPHIC MATERIAL

Figure 1:
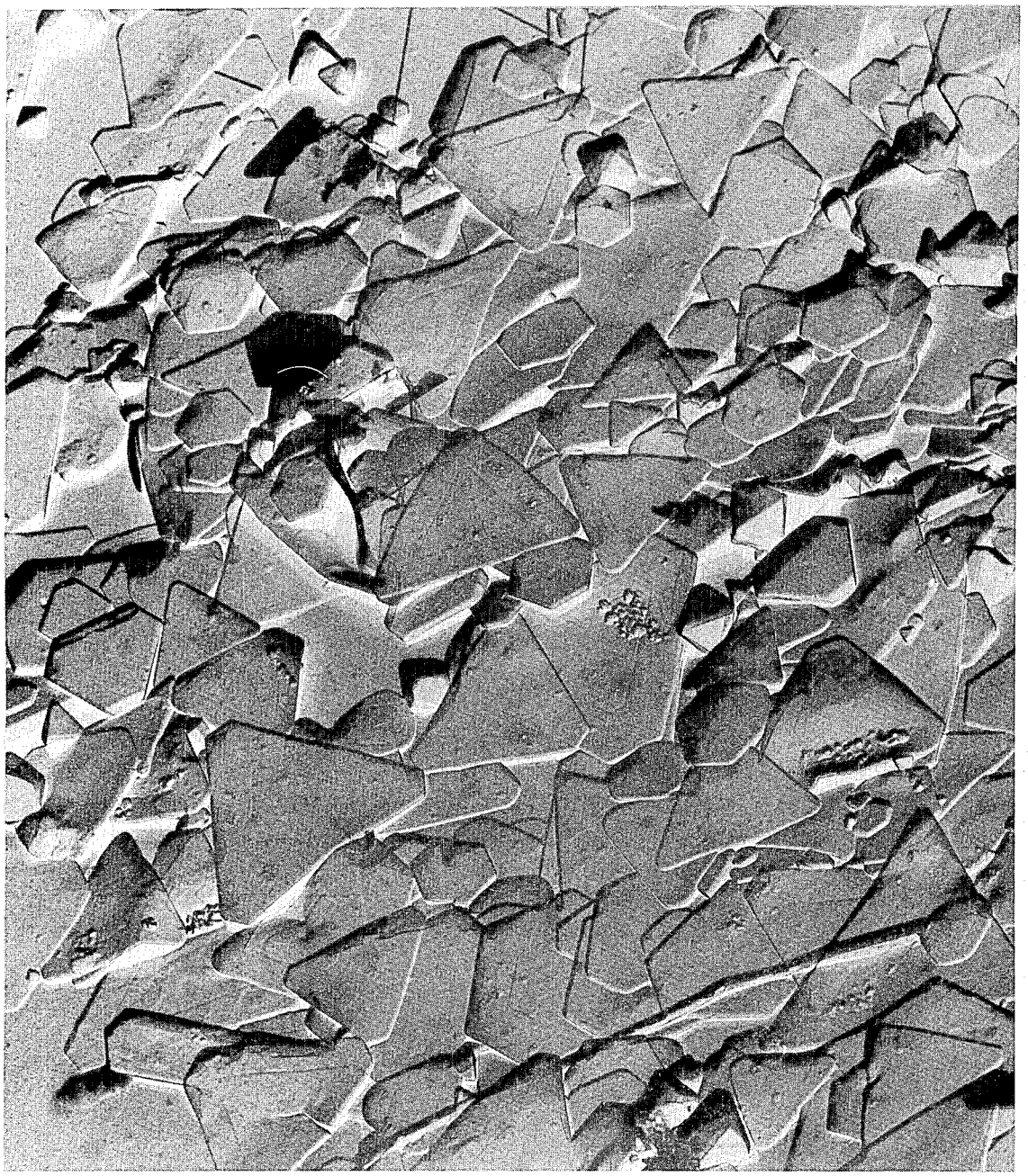

This invention relates to a photographic material comprising a support and at least one photosensitive silver halide emulsion layer of which the silver halide grains are selectively etched.

It is known to be of advantage to a number of photographic properties for the silver halide microcrystals to have a large surface. In EP-A-215 612, J.E. Maskasky describes platelet-like emulsion grains having a high aspect ratio, of which the already large surface-to-volume ratio is even further increased by precipitation of more silver halide onto the grains. The crystals show irregular growths over the entire main crystal surfaces. In DE-A-32 41 647, the same author describes selective growths on plate-like crystals which also lead to enlargement of the surface.

The surface of an emulsion microcrystal can be enlarged not only by crystal growth, but also by etching of the crystals. Such etching is described by E. Klein and R. Matejec in Z. Electrochem. 62: 587 (1958) and Z. Angew. Phys. 12: 26 (1960) and by C.R. Berry in Sci. Ind. Photogr. 29: 364 (1958). However, etching of the crystals is difficult to control and the etched pits are formed irregularly over the crystal surface. In terms of sensitometry, etching as described in "Die Grundlagen der Photographischen Prozesse", edited by H. Frieser, G. Hasse and E. Klein, Akademische Verlagsgesellschaft, Frankfurt (1968), page 374, often gives rise to increased fogging.

It has now been found that the surface of silver halide grains in photographic emulsions, of which the silver halide grains have a layered structure of at least two different layers extending to the surface of the grain and which preferably have an aspect ratio of at least 5:1, can be selectively etched and thus made larger. Surface etching can be carried out in particular on plate-like silver halide grains, which consist predominantly of AgIBr and in which the iodide is concentrated in one or more annular zones, using weak silver halide solvents, for example aqueous NaCl solution, surprisingly in places where the more difficultly soluble silver halide is present in higher concentrations than in adjacent regions where pure AgBr or AgIBr is present with a lower concentration of AgI. The etched grooves on the main crystal surfaces do not lead to sensitometric disadvantages, such as increased fogging. On the contrary, they form preferential zones for chemical ripening, spectral sensitization, latent image formation and development and thus lead to improved photographic properties, particularly higher sensitivity.

The silver halide dissolved out from the crystal during the etching process may be removed from the emulsion by suitable measures, for example by washing out. However, the effect of one particularly advantageous embodiment of the invention is that most of the silver halide dissolved out from a silver halide microcrystal is re-deposited as an epitaxial growth in a recrystallization process at another point of the same crystal or on another crystal of the emulsion. In this embodiment, the emulsion does not lose any silver halide and the surface of the grains is additionally enlarged.

Accordingly, the present invention relates to a photographic material comprising a support and at least one photosensitive silver halide emulsion layer, characterized in that the silver halide grains of the silver halide emulsion layer have a layered structure of at least two different layers extending to the surface of the grain and are selectively etched, preferably in the vicinity of the surface layer formed from the more difficultly soluble silver halide.

The difference between the layers which is manifested in the selective etchability is very probably attributable to a different halide composition emanating from the production process, in which a halide is only added at certain times during the precipitation process.

However, crystal lattice disturbances which promote etchability can occur at the etchable sites through the way in which the process is managed.

In addition to the silver halide grains, the silver halide emulsion layer contains at least one binder.

Gelatin is preferably used as the binder, although it may be completely or partly replaced by other synthetic, semisynthetic or even naturally occurring polymers. Synthetic gelatin substitutes are, for example, polyvinylalcohol, poly-N-vinylpyrrolidone, polyacrylamides, polyacrylic acid and derivatives thereof, particularly copolymers. Naturally occurring gelatin substitutes are, for example, other proteins, such as albumin or casein, cellulose, sugar, starch or alginates. Semisynthetic gelatin substitutes are generally modified natural products, of which examples are cellulose derivatives, such as hydroxyalkyl cellulose, carboxymethyl cellulose and phthalyl cellulose, and gelatin derivatives which have been obtained by reaction with alkylating or acylating agents or by grafting on of polymerizable monomers.

The binders should have a sufficient number of functional groups, so that sufficiently resistive layers can be produced by reaction with suitable hardeners. Functional groups of the type in question are, in particular, amino groups, but also carboxyl groups, hydroxyl groups and active methylene groups.

The gelatin preferably used may be obtained by acidic or alkaline digestion. The production of such gelatins is described, for example, in "The Science and Technology of Gelatine", edited by A.G. Ward and A. Courts, Academic Press 1977, pages 295 et seq. The particular gelatin used should have a minimal content of photographically active impurities (inert gelatin). Gelatins of high viscosity and low swelling and oxidized gelatins are particularly advantageous.

The silver halide present as photosensitive component in the photosensitive silver halide emulsion layer contains at least two halides from the series chloride, bromide or iodide, the various layers extending to the surface having different halide compositions. The crystals may be predominantly compact crystals which may have, for example, regular cubic or octahedral forms or transitional forms.

Suitable crystals are, for example, the silver halide crystals described in GB-P No. 2,038,792. The crystals are preferably platelet-like crystals of which the average diameter-to-thickness ratio is preferably at least 5:1, the diameter of a grain being defined as the diameter of a circle having an area corresponding to the projected area of the grain.

The silver halide grains may also have a multilayer grain structure, the halide composition and/or other modifications, such as for example doping of the individual grain zones, being different, for example layers of silver bromide and silver bromide iodide or of silver chloride and silver chloride bromide which follow one another annularly. The average grain size of the emulsions is preferably between 0.2 μm and 2.0 μm while the grain size distribution may be both homodisperse and also heterodisperse. A homodisperse grain size distribution means that 95% of the grains deviate from the average grain size by no more than ±30%. In addition to the silver halide, the emulsions may also contain organic silver salts, for example silver benztriazolate or silver behenate.

Two or more types of silver halide emulsions prepared separately may be used in admixture.

The photographic emulsions may be prepared from soluble silver salts and soluble halides by various methods (cf. for example P. Glafkides, Chimie et Physique Photographique, Paul Montel, Paris (1967), G.F. Duffin, Photographic Emulsion Chemistry, The Focall Press, London (1966), V.L. Zelikman et al., Making and Coating Photographic Emulsion, The Focal Press, London (1966)).

Precipitation of the silver halide preferably occurs in the presence of the binder, for example the gelatin, and may be carried out in an acidic, neutral or alkaline pH range, preferably in the additional presence of silver halide complexing agents, including for example ammonia, thioether, imidazole, ammonium thiocyanate or excess halide. The water-soluble silver salts and the halides may be combined either successively by the single-jet process or simultaneously by the double-jet process or by a combination of these two processes. Dosing at increasing inflow rates is preferred, although the "critical" feed rate, at which new seeds are still not quite formed, should not be exceeded. The pAg range may vary within wide limits during the precipitation process. The so-called pAg-controlled process is preferably used. In this process, a certain pAg value is kept constant or the pAg value passes through a certain pAg profile during the precipitation process. However, in addition to the preferred precipitation where halide is present in excess, so-called inverse precipitation is also possible where silver ions are present in excess. The silver halide crystals can grow not only through precipitation, but also by physical ripening (Ostwald ripening) in the presence of excess halide and/or silver halide complexing agent. The emulsion grains may even be predominantly grown by Ostwald ripening, in which case a fine-grained, so-called Lippmann emulsion is preferably mixed with a more difficultly soluble emulsion and dissolved in and allowed to crystallize thereon, always with the proviso that the water-soluble halides are added in such a way that layers of different halide composition extending to the surface of the final crystal are produced.

Salts or complexes of metals, such as Cd, Zn, Pb, Tl, Bi, Ir, Rh, Fe, may also be present during the precipitation and/ or physical ripening of the silver halide grains.

To achieve the layered structure according to the invention, the production process is preferably carried out in such a way that one of the halides is only added for a brief period during the precipitation process.

The etchable area may amount to between 5 and 95% and preferably to between 5 and 30% of the total surface.

Suitable halide systems are, for example, bromide/-bromide iodide, bromide iodide/bromide iodide with different iodide contents, chloride/chloride bromide, chloride/bromide, chloride bromide/chloride bromide with different bromide contents.

Bromide/bromide iodide systems of which the iodide content in the bromide iodide layer is from 2 to 30 mol-% are preferred.

The precipitation process may also take place in the presence of sensitizing dyes. Complexing agents and/or dyes may be inactivated at any stage, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatin, silver halide and sensitizer concentration) until the sensitivity and fogging optimum is reached. The process in question is described, for example, in H. Frieser "Die Grundlagen der Photographischen Prozesse mit Silberhalogeniden", pages 675–734, Akademische Verlagsgesellschaft (1968).

The chemical sensitization may be carried out with addition of compounds of sulfur, selenium, telurium and/or compounds of metals of the VIIIth secondary group of the periodic system (for example gold, platinum, palladium, iridium) and also with addition of thiocyanate compounds, surface-active compounds, such as thioethers, heterocyclic nitrogen compounds (for example imidazoles, azaindenes), or even spectral sensitizers (described for example in F. Hamer "The Cyanine Dyes and Related Compounds", 1964, or in Ullmanns Encyclopedie der technischen Chemie, 4th Edition, Vol. 18, pages 431 et seq. and Research Disclosure no. 17643, Section III). Instead of or in addition to chemical sensitization, reduction sensitization may be carried out with addition of reducing agents (tin-II salts, amines, hydrazine derivatives, aminoboranes, silanes, formamidine sulfinic acid), by hydrogen, by a low pAg value (for example below 5) and/or a high pH value (for example above 8).

The photographic emulsions may contain compounds for preventing fogging or for stabilizing the photographic function during production, storage or photographic processing.

Azaindenes, preferably tetra- and penta-azaindenes, especially those substituted by hydroxyl or amino groups, are particularly suitable. Compounds such as these are described, for example, by Birr in Z. Wiss. Phot. 47 (1952), pages 2–58.. Other suitable antifogging agents are salts of metals, such as mercury or cadmium, aromatic sulfonic or sulfinic acids, such as benzenesulfinic acid, or nitrogen-containing heterocycles, such as nitrobenzimidazole, nitroindazole, (substituted) benztriazoles or benzthiazolium salts. Heterocycles containing mercapto groups, for example mercaptobenzthiazoles, mercaptobenzimidazoles, mercaptotetrazoles, mercaptothiadiazoles, mercaptopyrimidines, are particularly suitable; these mercaptoazoles may even contain a water-solubilizing group, for example a carboxyl group or sulfo group. Other suitable compounds are described in Research Disclosure no. 17643 (1978), Section VI.

The stabilizers may be added to the silver halide emulsions before, during or after their ripening. The compounds may of course also be added to other photographic layers asssociated with a silver halide layer.

Mixtures of two or more of the compounds mentioned may also be used.

Etching is carried out by treatment of the ripened silver halide gelatin emulsion with weak silver halide solvents, for example with an aqueous NaCl solution, at any time after precipitation, for example even after application of the emulsion to a support and drying. The etching agent is removed again by washing out after etching. This may be done particularly easily together with removal of the soluble salts after precipitation and etching by ultrafiltration. The photographic emulsion layers or other hydrophilic colloid layers of the photosensitive material produced in accordance with the invention may contain surfactants for various purposes, such as coating aids, for preventing electrical charging, for improving antiblocking properties, for emulsifying the dispersion, for preventing adhesion and for improving the photographic characteristics (for example development acceleration, high contrast, sensitization, etc.).

The photographic emulsions may be spectrally sensitized using methine dyes or other dyes. Particularly suitable dyes are cyanine dyes, merocyanine dyes and complex merocyanine dyes.

There is no need to use sensitizers if the natural sensitivity of the silver halide for a certain spectral region, for example the blue sensitivity of silver halide, is sufficient.

Color photographic materials normally contain at least one red-sensitive emulsion layer, one green-sensitive emulsion layer and one blue-sensitive emulsion layer. Non-diffusing monomeric or polymeric color couplers are associated with these emulsion layers, being arranged either in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type, of which suitable examples can be found in the literature.

Color couplers for producing the yellow component dye image are generally couplers containing an open-chain ketomethylene group, particularly couplers of the α-acylacetamide type, of which suitable examples are α-benzoylacetanilide couplers and α-pivaloylacetanilide couplers, which are also known from the literature.

Color couplers for producing the magenta component dye image are generally couplers of the 5-pyrazolone type, the indazolone type or the pyrazoloazole type, of which suitable examples can be found in large numbers in the literature.

The color couplers may be 4-equivalent couplers and also 2-equivalent couplers. 2-Equivalent couplers are derived from the 4-equivalent couplers through the fact that they contain in the coupling position a substituent which is eliminated during the coupling reaction. 2-Equivalent couplers include those which are colorless and also those which have a strong color of their own which either disappears during the color coupling reaction or is replaced by the color of the image dye produced (masking couplers); and white couplers which produce largely colorless products on reaction with color developer oxidation products. The 2-equivalent couplers also include couplers which contain in the coupling position a releasable group which is released on reaction with color developer oxidation products and develops a certain, desirable photographic activity, for example as a development inhibitor or accelerator, either directly or after one or more other groups have been removed from the group initially formed (cf. for example DE-A-27 03 145, DE-A-28 55 697, DE-A-31 05 026, DE-A-33 19 428). Examples of 2-equivalent couplers such as these are the known DIR couplers and also DAR and FAR couplers.

Since, with DIR, DAR and FAR couplers, it is primarily the activity of the group released during the coupling reaction which is required rather than the dye-producing properties of these couplers, DIR, DAR and FAR couplers which give substantially colorless products during the coupling reaction (DE-A-15 47 640) are also suitable.

The releasable group may also be a ballast group, so that coupling products which are capable of diffusing or which at least show weak or limited mobility are obtained during the reaction with color developer oxidation products (US-A-4,420,556).

High molecular weight color couplers are described, for example, in DE-C-1 297 417, DE-A-24 07 569, DE-A-31 48 125, DE-A-32 17 200, DE-A-33 20 079, DE-A-33 24 932, DE-A33 31 743, DE-A-33 40 376, EP-A-27 284, US-A-4,080,211. The high molecular weight color couplers are generally produced by polymerization of ethylenically unsaturated, monomeric color couplers. However, they may also be obtained by polyaddition or polycondensation.

The couplers or other compounds may be incorporated in silver halide emulsion layers by initially preparing a solution, dispersion or emulsion of the compound in question and adding it to the casting solution for the particular layer. The choice of the suitable solvent or dispersant depends upon the solubility of the particular compound.

Methods for introducing substantially water-insoluble compounds by grinding processes are described, for example, in DE-A-26 09 741 and in DE-A-26 09 742.

Hydrophobic compounds may also be introduced into the casting solution using high-boiling solvents, so-called oil formers. Corresponding methods are described, for example, in US-A-2,322,027, US-A-2,801,170, US-A-2,801,171 and EP-A-0,043,037.

Oligomers or polymers, so-called polymeric oil formers, may be used instead of the high-boiling solvents.

The compounds may also be introduced into the casting solution in the form of charged latices, cf. for example DE-A-25 41 238, DE-A-25 41 274, DE-A-28 35 856, EP-A-0 014 921, EP-A-0 069 671, EP-A-0 130 115, US-A-4,291,113.

Anionic water-soluble compounds, for example dyes, may also be incorporated in non-diffusing form using cationic polymers, so-called mordant polymers.

Suitable oil formers are, for example, phthalic acid alkyl ester, phosphoric acid esters, citric acid esters, benzoic acid esters, alkylamides, fatty acid esters and trimesic acid ester.

Color photographic material typically comprises at least one red-sensitive emulsion layer, at least one green-sensitive emulsion layer and at least one blue-sensitive emulsion layer on supports. The order of these layers may be varied as required. Couplers forming cyan, magenta and yellow dyes are normally incorporated in the red-sensitive, green-sensitive and blue-sensitive emulsion layers. However, different combinations may also be used.

Each of the photosensitive layers may consist of a single layer or may even comprise two or more partial silver halide emulsion layers (DE-C-11 21 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being arranged between green-sensitive layers and blue-sensitive layers.

Given a suitably low natural sensitivity of the green-sensitive and red-sensitive layers, it is possible - with elimination of the yellow filter layer - to select other layer arrangements in which, for example, the blue-sensitive, then the red-sensitive and, finally, the green-sensitive layers follow one another on the support.

The non-photosensitive intermediate layers generally arranged between layers of different spectral sensitivity may contain agents which prevent unwanted diffusion of developer oxidation products from one photosensitive layer into another photosensitive layer with different spectral sensitization.

Where several partial layers of the same spectral sensitization are present, they may differ from one another in their composition, particularly in regard to the type and quantity of silver halide crystals. In general, the partial layer of higher sensitivity will be arranged further away from the support than the partial layer of lower sensitivity. Partial layers having the same spectral sensitization may be arranged adjacent one another or may be separated by other layers, for example by layers of other spectral sensitization. For example, all the high-sensitivity layers and all the low-sensitivity layers may be combined with one another to form a single layer set (DE-A 19 58 709, DE-A 25 30 645, DE-A 26 22 922).

The photographic material may also contain UV absorbers, white toners, spacers, filter dyes, formalin acceptors, etc.

UV absorbers on the one hand should protect the image dyes against bleaching out by UV-rich daylight and, on the other hand, should as filter dyes absorb the UV light in daylight during exposure, thus improving the color reproduction of a film. Compounds of different structure are normally used for these two functions. Examples include arylsubstituted benzotriazole compounds (US-A 3,533,794), 4-thiazolidone compounds (US-A 3,314,794 and 3,352,681), benzophenone compounds (JP-A 2784/71), cinnamic ester compounds (US-A 3,705,805 and 3,707,375), butadiene compounds (US-A 4,045,229)or benzoxazole compounds (US-A 3,700,455).

UV-absorbing couplers (such as cyan couplers of the α-naphthol type) and UV-absorbing polymers may also be used. These UV absorbers may be fixed in a special layer by mordanting.

Filter dyes suitable for visible light include oxanol dyes, hemioxanol dyes, styrene dyes, merocyanine dyes, cyanine dyes and azo dyes. Of these dyes, oxanol dyes, hemioxanol dyes and merocyanine dyes are used with particular advantage.

Suitable white toners are described, for example, in Research Disclosure 17643, December 1978, Chapter V, pages 22 et seq.

Certain binder layers, particularly the layer arranged furthest from the support, but occasionally intermediate layers, particularly where they represent the layer furthest from the support during the production process, may contain photographically inert, inorganic or organic particles, for example as matting agents or as spacers (DE-A 33 31 542, DE-A 34 24 893, Research Disclosure 17643, December 1978, Chapter XVI, pages 22 et seq.).

The average particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The binders of the material according to the invention, particularly where gelatin is used as binder, are hardened with suitable hardeners, for example with hardeners of the epoxide type, the ethylene imine type, the acryloyl type or the vinylsulfone type. Hardeners of the diazine, triazine or 1,2-dihydroquinoline series are also suitable.

The binders of the material according to the invention are preferably hardened with instant hardeners.

Instant hardeners are understood to be compounds which crosslink suitable binders in such a way that, immediately after casting and, at the latest, 24 hours after casting and preferably 8 hours after casting at the lastest, hardening has progressed to such an extent that there is no further change in the sensitometric data or in the swelling of the layers through the crosslinking reaction. By swelling is meant the difference between wet layer thickness and dry layer thickness in the aqueous processing of the film (Photogr. Sci. Eng. 8 (1964), 275; Photogr. Sci. Eng. (1972), 449).

These hardeners which react very quickly with gelatin are, for example, carbamoyl pyridinium salts which are capable of reacting with free carboxyl groups of the gelatin so that the free carboxyl groups react with free amino groups of the gelatin with formation of peptide bonds and cross-linking of the gelatin.

Suitable instant hardeners are, for example, compounds corresponding to the following general formulae

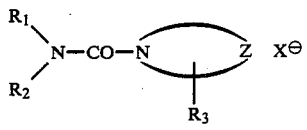

(a)

in which $R_1$ represents alkyl, aryl or aralkyl, $R_2$ has the same meaning as $R_1$ or represents alkylene, arylene, aralkylene qr alkaralkylene, the second bond being attached to a group of the formula

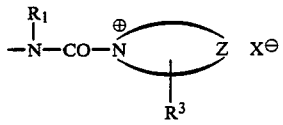

or $R_1$ and $R_2$ together represent the atoms required to complete an optionally substituted heterocyclic ring, for example a piperidine, piperazine or morpholine ring, which may be substituted, for example, by $C_1$–$C_3$ alkyl or halogen, $R_3$ represents hydrogen, alkyl, aryl, alkoxy, $—NR_4—COR_5$, $—(CH_2)_m—(NR_8R_9$,$—(CH_2)_n—CONR_{13}R_{14}$ or

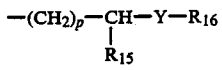

or is a bridge member or a direct bond to a polymer chain, $R_4$, $R_7$, $R_9$, $R_{14}$, $R_{15}$, $R_{17}$, $R_{18}$and $R_{19}$ being hydrogen or $C_1$-$C_4$-alkyl, $R_5$ is hydrogen, $C_1$-$C_4$ alkyl or $NR_6R_7$, $R_8$ is $—COR_{10}$, $R_{10}$ is $NR_{11}R_{12}$, $R_{11}$ is $C_{1-C4}$ alkyl or aryl, particularly phenyl, $R_{12}$ is hydrogen, $C_{1-C4}$ alkyl or aryl, particularly phenyl, $R_{13}$ is hydrogen, $C_{1-C4}$ alkyl or aryl, particularly phenyl, $R_{16}$ is hydrogen, $C_{1-C4}$ alkyl, $COR_{18}$ or $CONHR_{19}$, m is a number of 1 to 3, n is a number of 0 to 3, p is a number of 2 to 3 and Y is 0 or $NR_{17}$ or $R_{13}$ and $R_{14}$ together represent the atoms required to complete an optionally substituted heterocyclic ring, for example a piperidine, piperazine or morpholine ring, which may be substituted, for example, by $C_{1-C3}$ alkyl or halogen, Z represents the carbon atoms required to complete a 5- or 6-membered aromatic heterocyclic ring, optionally with an anellated benzene ring, and $X^{\ominus}$ is an anion which is redundant where an anionic group is already attached to the rest of the molecule;

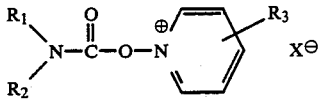

(b)

in which $R_1$, $R_2$, $R_3$,and $X^{\ominus}$ are as defined for formula (a).

The materials according to the invention, whether color negative or color reversal films, color negative or color reversal paper or direct positive materials, are processed in the usual way by the recommended processes.

EXAMPLE 1

Emulsion A containing platelet-like crystals and one AgIBr ring

Emulsion A is prepared by the double feed process. To this end, a solution of 140 g potassium bromide in 470 ml water and a solution of 170 g silver nitrate in 470 ml water are simultaneously added with thorough stirring over a period of 35 minutes at 70° C. to 1.7 liters water containing 25 g inert bone gelatin and 25 g potassium bromide, the feed rate being 12 times higher at the end than at the beginning. 18 Minutes after the beginning of the addition of the silver nitrate and potassium bromide solutions, a solution of 850 mg potassium iodide in 20 ml water is also added over a period of 1 minute. The pBr value is kept at 1.0 during the precipitation. The emulsion is then freed from excess salts by the coagulation method and redispersed with addition of more inert bone gelatin, so that the silver halide content of the final emulsion is 1 mol/kg and the gelatin-to-silver halide ratio (expressed as $AgNO_3$) 0.3. The emulsion contains predominantly platelet-like crystals having an average diameter of the main crystal surfaces (diameter of a circle of equal area) of approximately 2 μm and an average grain volume (diameter of a sphere of equal volume) of approximately 1.0 μm; aspect ratio 12:1. They contain an annular zone of AgIBr and, outside that zone, consist of pure AgBr. The position of the annular AgIBr zone was determined by low-temperature luminescence microscopy [described by J.E. Maskasky in J. Imag. Sci. 31: 15 (1987)]and is approximately in the middle of the radius of the main crystal surfaces.

Emulsion A was applied to a polyester support in a layer thickness of 60 μm and dried. The coated support was treated for 5 minutes at 20° C. in a solution of 117 g NaCl in 1 liter water and then rinsed for 20 minutes. The crystals obtained showed etched grooves on their main crystal surfaces, but are otherwise largely unaffected; they are shown in an electron micrograph (carbon print, magnification × 10,000) in FIG. 1.

EXAMPLE 2

Emulsion B containing platelet-like crystals and five AgIBr rings

An emulsion is prepared using the solutions described in Table 1. To this end, solution 2 is quickly added to solution 1 with thorough stirring over a period of 7 minutes at 80° C., the feed rate at the end being 4 times higher than at the beginning. 5 Minutes after the beginning of the addition of solution 2, solution 3 is also added over a period of 1 minute. The pBr value is reduced from 1.2 to 0.9 during the addition of solution 2. Thereafter, solutions 4 and 5 are quickly added over a period of 13 minutes by the double feed process, the feed rate being 2.2 times higher at the end than at the beginning. The pBr value is kept at 0.9. 5 Minutes, 9 minutes and 13 minutes after the beginning of the addition of solutions 4 and 5, solutions 6, 7 and 8 are each added over a period of 1 minute. Solution 9 is then added over a period of 3 minutes, the pBr value falling to 0.7. Solutions 10 and 11 are then quickly added simultaneously over a period of 16 minutes, the feed rate being 1.5 times higher at the end than at the beginning and the pBr value being kept at 0.7. 8 Minutes after the beginning of the addition of solutions 10 and 11, solution 12 is added over a period of 1 minute. Finally, solution 13 is added over a period of 13 minutes.

One half of the emulsion is then free from excess salts by the coagulation process and redispersed with addition of more inert bone gelatin. Emulsion B1 containing 1 mol silver halide/kg and 5% gelatin is obtained. The emulsion contains predominantly platelet-like crystals having an average diameter of the main crystal surfaces of 5 μm and an average grain volume (diameter of a sphere of equal volume) of 1.5 μm; aspect ratio 50:1. They contain 5 AgIBr rings, but otherwise consist of pure AgBr. The position of the rings was again determined by low-temperature luminescence microscopy.

TABLE 1

| | Solutions for emulsion B | | | | |
|---|---|---|---|---|---|
| Solution no. | $AgNO_3$ | KBr | KI | Gelatin | Water |
| 1 | — | 16.0 g | — | 11.3 g | 750 ml |
| 2 | 12.5 g | — | — | — | 70 ml |
| 3 | — | — | 0.1 g | — | 15 ml |
| 4 | 88.5 g | — | — | — | 260 ml |
| 5 | — | 75.7 g | — | — | 260 ml |
| 6 | — | — | 0.1 g | — | 15 ml |

TABLE 1-continued

| Solution no. | Solutions for emulsion B | | | | |
|---|---|---|---|---|---|
| | $AgNO_3$ | KBr | KI | Gelatin | Water |
| 7 | — | — | 0.1 g | | 15 ml |
| 8 | — | — | 0.1 g | — | 15 ml |
| 9 | 17.0 g | — | — | — | 55 ml |
| 10 | 117.0 g | — | — | — | 385 ml |
| 11 | — | 87.8 g | — | — | 385 ml |
| 12 | — | — | 0.1 g | — | 15 ml |
| 13 | 20.0 g | — | — | — | 60 ml |

Figure 2:
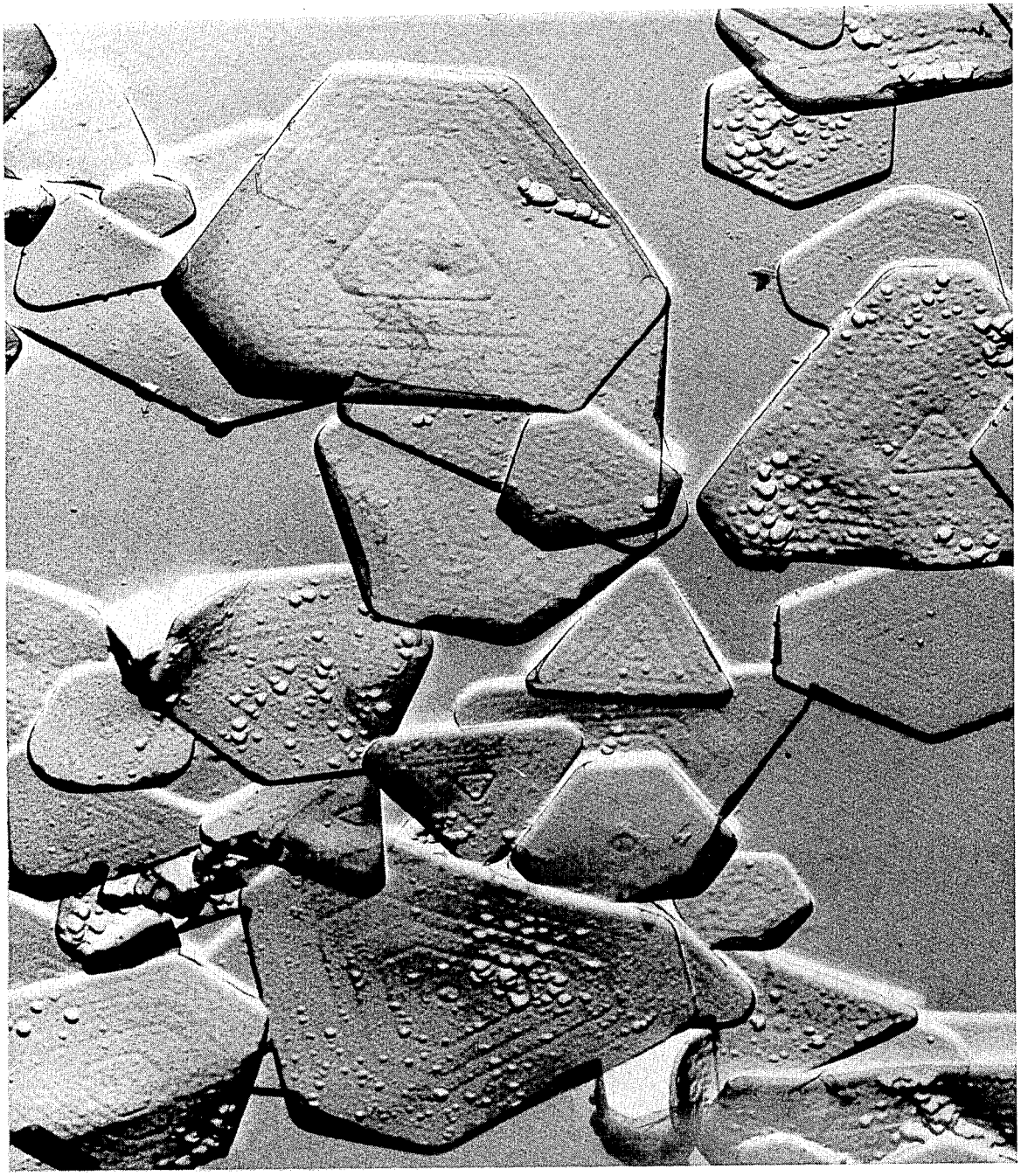

Emulsion B2 was prepared from the second half of emulsion B in the same way as emulsion BI, but was not only thoroughly washed with water after coagulation, but was additionally treated with a solution of 200 g NaCl in 2 liters water for 20 minutes at 20° C. and then thoroughly washed with water again. The electron micrograph of emulsion B2 in FIG. 2 clearly shows the etched grooves formed by the additional treatment with an NaCl solution in the places containing the iodide.

The emulsions were chemically ripened for 80 and 115 minutes at 58° C. with 14 μmol/mol Ag sodium thiosulfate, 2 μmol/mol Ag potassium tetrachloroaurate and 260 μmol/mol Ag potassium thiocyanate. Cast samples of the emulsion were exposed through a step wedge and developed with a developer having the following composition:

| | |
|---|---|
| n-methyl-p-aminophenol | 3.5 g |
| sodium sulfite, anhydrous | 60.0 g |
| hydroquinone | 9.0 g |
| sodium carbonate, anhydrous | 40.0 g |
| potassium bromide | 3.5 g |
| | dissolved in 1 l water |

The sensitometric data shown in Table 2 were obtained, the sensitivity being shown as the exposure (100.log-[I.t]) required to obtain an optical density of 0.2 over the fogging.

TABLE 2

Sensitometric data of emulsions B1 and B2

| Emulsion | Ripening time 80 minutes | | Ripening time 115 minutes | |
|---|---|---|---|---|
| | Es + 0.2 | S | Es + 0.2 | S |
| B1 (comparison) | 100 | 0.27 | 108 | 0.60 |
| B2 (invention) | 108 | 0.28 | 115 | 0.51 |

It can be seen that the emulsion according to the invention shows a higher sensitivity for lower fogging.

I claim:

1. A photographic material comprising a support and at least one photosensitive silver halide emulsion layer, wherein the silver halide grains of the silver halide emulsion layer are platelet-like in shape and have an aspect ratio of at least 5:1, have a layered structure of at least 2 layers extending to the surface of the grain, consist predominantly of AgIBr, in which the iodide is concentrated in one or more annular zones and are selectively etched in a way that etching is carried out in the zones of higher iodide content.

2. A photographic material as claimed in claim 1, characterized in that the silver halide removed from the grains by etching is epitaxially deposited elsewhere.

* * * * *